US006946594B2

(12) United States Patent
Bruti et al.

(10) Patent No.: US 6,946,594 B2
(45) Date of Patent: Sep. 20, 2005

(54) METHOD FOR REPRODUCING THE SOUND OF AN ACCORDION ELECTRONICALLY

(75) Inventors: Luigi Bruti, Pedaso (IT); Demetrio Cuccu', Fermo (IT); Roberto Gaetani, San Benedetto del Tronto (IT)

(73) Assignee: Roland Europe S.p.A., Martinsicuro (IT)

( * ) Notice: Subject to any disclaimer, the term of this patent is extended or adjusted under 35 U.S.C. 154(b) by 68 days.

(21) Appl. No.: 10/132,260

(22) Filed: Apr. 26, 2002

(65) Prior Publication Data

US 2003/0005815 A1 Jan. 9, 2003

(30) Foreign Application Priority Data

Apr. 27, 2001 (IT) ..... BO2001A0255

(51) Int. Cl.[7] ..... G10H 7/02

(52) U.S. Cl. ..... 84/604; 84/626; 84/662; 84/376 R; 84/376 EA

(58) Field of Search ..... 84/603–608, 645, 84/376 R, 376 A, 376 EA, 376 K, 376 SM, 662, 663, 632, 633, 626, 627, 376 RT, 732, 710, 375–378

(56) References Cited

U.S. PATENT DOCUMENTS

| | | | | | |
|---|---|---|---|---|---|
| 3,278,671 | A | | 10/1966 | Berwin | |
| 3,402,251 | A | | 9/1968 | Bright | |
| 3,610,802 | A | | 10/1971 | Berwin | |
| 3,647,928 | A | * | 3/1972 | Turner | 84/708 |
| 3,776,089 | A | * | 12/1973 | Cohen | 84/376 R |
| 3,918,343 | A | * | 11/1975 | Gumina | 84/376 EA |
| 3,999,457 | A | * | 12/1976 | Michel | 84/702 |
| 4,196,650 | A | * | 4/1980 | Fricke et al. | 84/687 |
| 4,217,803 | A | * | 8/1980 | Dodds | 84/687 |
| 4,383,463 | A | * | 5/1983 | Aliprandi | 84/741 |
| 5,880,391 | A | * | 3/1999 | Westlund | 84/645 |
| 2002/0056358 | A1 | * | 5/2002 | Ludwig | 84/738 |

FOREIGN PATENT DOCUMENTS

| | | |
|---|---|---|
| WO | WO 98/50904 | 11/1998 |

* cited by examiner

*Primary Examiner*—Marlon T. Fletcher
*Assistant Examiner*—David S. Warren
(74) *Attorney, Agent, or Firm*—Foley & Lardner LLP

(57) ABSTRACT

Method for electronically reproducing the sound of an acoustic accordion, that is provided with a number of keys/buttons, which can be pressed individually so as to excite a corresponding number of reeds that are coupled with every single key/button; for electronically reproducing the sound generated by pressing each key/button, the sounds that are characteristic of each reed that is coupled with a key/button are generated individually and electronically.

46 Claims, 2 Drawing Sheets

METHOD FOR REPRODUCING THE SOUND OF AN ACCORDION ELECTRONICALLY

BACKGROUND OF THE INVENTION

The present invention relates to a method for reproducing the sound of an accordion electronically.

An acoustic accordion is a musical instrument provided with a bellow pumping air towards some valves, which are controlled by a number of corresponding keys/buttons divided into two keyboards (one being controlled by the right hand and the other one controlled by the left hand). Each valve and consequently each key/button is capable of sending the air that is pumped by the bellow to a series of corresponding reeds, which are all coupled with the same valve, belong to different footages and vibrate basically together to produce the note associated with that particular key/button. Moreover the acoustic accordion is provided with a series of registers capable of modifying the features of the sound produced by pressing keys/buttons because they can either let some reeds relating to some corresponding footages vibrate or prevent them from vibrating. Every single reed in an acoustic accordion commonly consists of a thin plate provided with a hole to let air coming from the corresponding valve flow through it, whereby such hole can be stopped by closing a small window that is controlled by a corresponding register.

Electronic accordions are available on the market, which are provided with a bellow coupled with a pressure sensor so as to generate a pressure signal that is proportional to the pressure of the air being pumped by the bellow; they are also provided with keyboards which are coupled with a number of sensors so as to generate a series of keyboard signals reproducing the pressure of keys/buttons; the pressure signal and the keyboard signals are transmitted to a sound module capable of generating the corresponding accordion sound electronically. The operation of the current sound modules is based on sampling and storing characteristic sounds being produced by individual keys/buttons; on pressing a key/button the sound module reproduces the characteristic sound of that key/button as long as such key/button is released.

By comparing the sound produced by an acoustic accordion with the sound produced by the state-of-the-art electronic accordions, it becomes clear that the quality level of the sound produced by electronic accordions is rather poor and it's not suited to professional or semi-professional performances.

BRIEF SUMMARY OF THE INVENTION

The purpose of the present invention is to provide a method for the electronic reproduction of the accordion sound, which is deprived of the above described inconveniences whose implementation is, however, easy and cost-effective at the same time.

According to the present invention a method for electronically reproducing the sound of an acoustic accordion, that is provided with a number of first keys/buttons, whereby each of them can be pressed to control a related valve, thus exciting a corresponding number of reeds that are coupled with said first key/button; such method providing for continually detecting the pressure of second keys/buttons, each of them corresponding to said first key/button as well as for electronically reproducing the sound produced by the corresponding first key on pressing a second key/button; the characteristic sound produced by the vibration of every single reed corresponding with the single reed; and whereby, on pressing each of said second keys/buttons, the characteristic sounds relating to each reed coupled with the first key are generated individually and electronically, so as to reproduce the sound of the corresponding first key/button by composing the characteristic sounds of each reed being coupled with that very first key/button.

DESCRIPTION OF THE DRAWINGS

The present invention is described here below with reference to the associated drawings, which show an example of its non restrictive implementation, whereby.

DETAILED DESCRIPTION OF THE INVENTION

Figure 1:
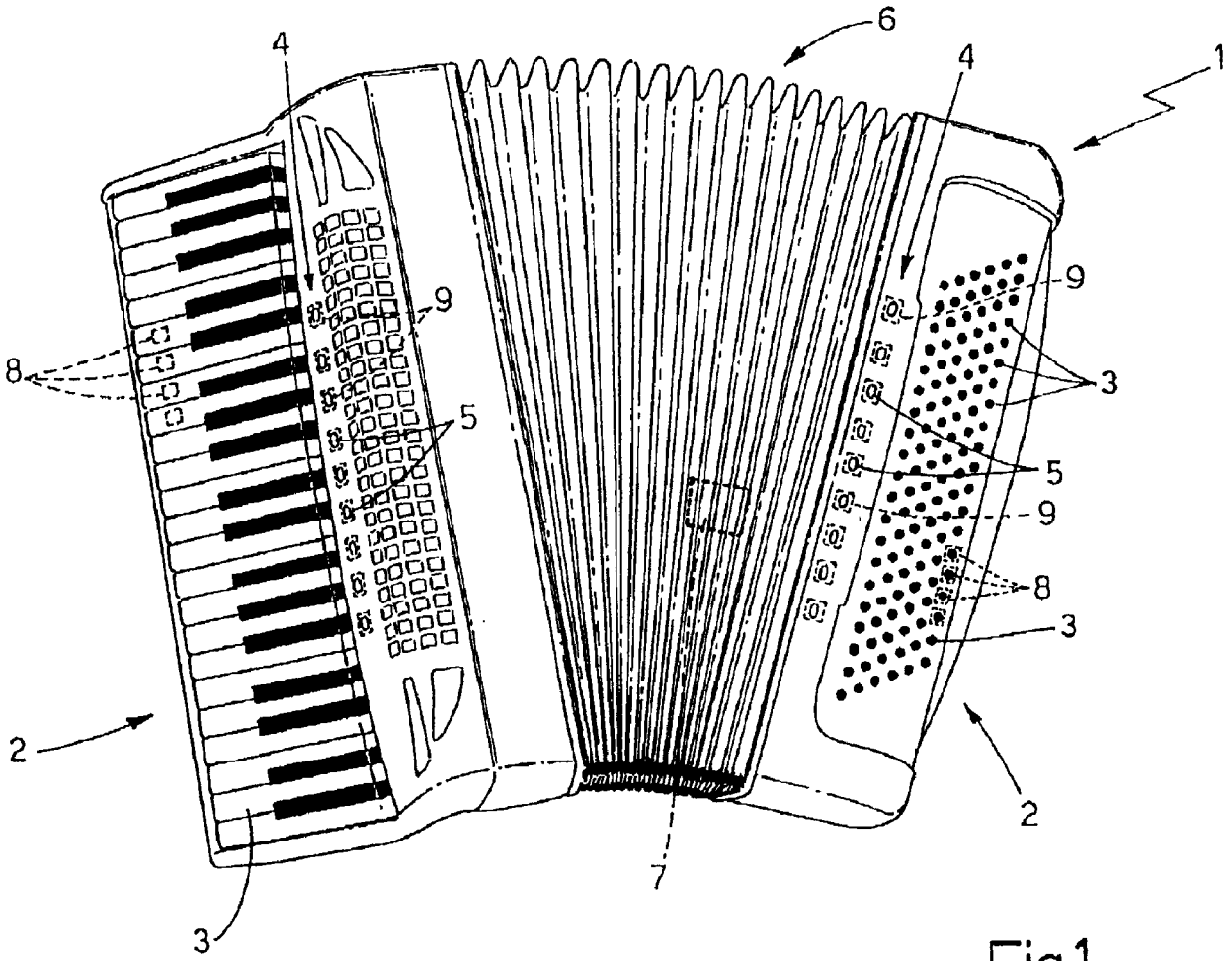
FIG. 1 shows an electronic accordion operating according to the method for the electronic reproduction of the sound that is the object of the present invention.

In the FIG. 1, the number 1 corresponds to the electronic accordion on the whole, whose external appearance is extremely similar to that of an acoustic accordion: it has two keyboards 2, which respectively consist of a number of keys/buttons 3 to play as well as of two selectors 4, each one comprising a number of registers 5 to be used to modify the sound features. Inside the electronic accordion 1 a bellow is built in, whose structure is identical to that of the bellow of an acoustic accordion; it pumps air towards an electromechanical pressure sensor 7 (which is basically a common sensor) capable of generating a signal A in realtime, such signal being coded in a standard manner and proportional to the air pressure P that is pumped by the bellow 6.

Every key/button 3 is connected with a corresponding sensor 8, that is capable of generating a corresponding T signal, such signal being coded in a standard manner and showing the position of the very key/button 3; according to two different alternative embodiments, each T signal is either a binary signal indicating just that the key/button 3 is pressed/released or a more complex signal indicating also the dynamic pressure/release of the corresponding key/button 3.

The dynamics of the pressure/release of a key/button 3 is commonly determined by as pressure/release velocity, that is the overall time duration of the pressing/releasing action.

Each register 5 is connected with a corresponding sensor 9, which is capable of generating a corresponding signal R, such signal being coded in a standard manner and indicating the position of a precise register 5 by means of a binary signal.

Figure 2:
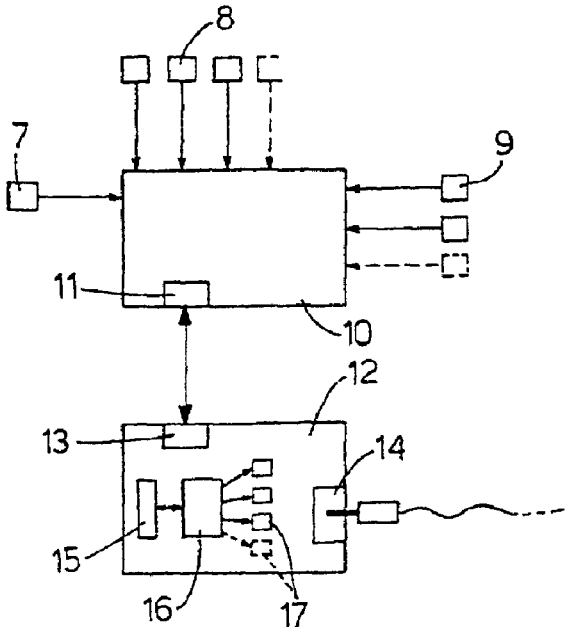
FIG. 2 shows the schematic operation of some devices provided in the electronic accordion shown in FIG. 1.

As shown in FIG. 2, the sensor 7, the sensors 8 and the sensors 9 are connected with a control unit 10, which utilizes a MIDI interface 11 to send the A, T and R signals to a sound module 12 in realtime, whereby such module is provided with its own MIDI interface 13; the sound module 12 is capable of generating the characteristic accordion sounds electronically and it's housed inside the electronic accordion 1. According to a different embodiment, which is not shown herein, the sound module 12 is located outside the electronic accordion 1 and it's connected with the electronic accordion 1 by means of its own MIDI interface 13; in this case, the sound module 12 could receive the A, T and R signals also from sources other than the electronic accordion 1; the A signal, for example, could come from a pedal, the T signals could come from a standard keyboard and the R signals could come from a common selector. Obviously, the sound module 12 is provided not only with a MIDI interface 13 but also with a standard not-amplified audio output 14 to control a sound amplifier (not shown).

If the electronic accordion 1 were an acoustic accordion, each key/button 3 in the keyboard 2 would be capable of opening a valve that sends the air pumped by the bellow 6 towards a number of reeds, which are all coupled with the same valve and therefore with the same key/button 3; so different footages belong to the same key/button 3 and they vibrate practically together to produce the note coupled with that key/button 3. If the electronic accordion 1 were an acoustic accordion, the registers 5 of the selectors 4 would be capable of altering the sound features, thus inhibiting or letting some reeds relating to some footages vibrate.

The sound module 12 comprises a memory 15, a processor 16 and a series of sound generators 17, that can be controlled by the processor 16 individually, so as to generate a sound according to the specifications provided by the very processor 16. In the memory 15 a series of sounds are stored, that are obtained by sampling the sounds produced by the various components of an acoustic accordions; in particular, in the memory 15 the characteristic sounds produced by the vibration of every single reed with both open and stopped valve are stored as well as all the noises produced whenever every single key/button 3 is released and consequently the corresponding valve is stopped. Moreover, in the memory 15 a table is stored to assign all those reeds to each key/button 3 that would be associated with that very key/button 3 in an acoustic accordion; by means of such table the processor 16 is capable of selecting the characteristic reed sounds associated with every single key/button 3 quickly.

When playing, a user selects the position of the registers 5 in the selectors 4, presses and releases the keys/buttons 3 in the keyboards 2 and operates the bellow 6; due to these actions the control unit 10 receives the temporal evolution of the corresponding signals A, T and R, from the sensors 7, 8 and 9 in realtime. The signals A, T and R are sent from the control unit 10 to the sound module 12 by means of the MIDI interfaces 11 and 13.

Depending on the R signals generated by the position of the registers 5, the processor 16 in the sound module 12 sets the values of the some control variables VC, which are stored in the memory 15 and are used, according to a detailed procedure, which is better explained further ahead, so as to define certain features of the sounds being generated by the sound module 12.

Depending on the A and T signals, the processor 16 in the sound module 12 controls the sound generators 17 in order to reproduce the sound of the electronic accordion 1. In particular, the processor 16 detects all variations occurring in the T signals, that is it detects all the commands given by the user to the keys/buttons 3 in the keyboards 2 (both types, when pressing the key/button 3 as well as when releasing the key/button 3) so as to get one or more sound generators 17 either started up or turned off according to some parameters which depend not only on the T signals but also on the A signals as well as on the VC control variables (these being in their turn dependent on the R signals).

When the user presses a key/button 3 in the keyboards 2, a corresponding variation in the related T signal is generated; such variation in the related T signal is detected by the processor 16, which acquires from the memory 15 the characteristic sounds of those reeds with open valve that would be coupled with the pressed key/button 3 in an acoustic accordion, excludes inactive reeds depending on the values of the VC control variables (i.e. the position of the registers 5) and drives a sound generator 17 corresponding to every operating reed according to a procedure, that is explained in detail further ahead, in order to make the sound generator 17 reproduce the characteristic sound of that very reed. This way the sound generated by pressing a key/button 3 is reproduced by composing all the characteristic sounds of a reed that is combined with a pressed key/button 3, those characteristic sounds being generated individually. Obviously the amplitude (volume) of the characteristic sound being generated by the operating reeds with opened valve is not constant and it depends on the P value relating to the pressure of the air pumped by the bellow 6, according to a bijective function that is stored in the memory 15 and is obtained in an experimental way.

When a key/button 3 in the keyboards 2 is released, a corresponding variation in the related T signal is generated; such variation in the related T signal is detected by the processor 16, which, according to a procedure explained in detail further ahead, switches off the sound generators 17 that are reproducing the characteristic sounds of those reeds, which would be coupled with the release key/button 3 in an acoustic accordion.

To achieve the highest possible fidelity level when reproducing the sound of an acoustic accordion, the processor 16 in the sound module 12 takes into account the mechanical inertia that a real reed would have, this mechanical inertia requires a certain pressure value P of the air being pumped by the bellow 6 in order to let a reed vibrate and causes some delays between the instant when a key/button 3 is pressed/released and the instant when a corresponding reed starts/stops vibrating. In combination with the characteristic sound produced by the vibration of a single reed, some data concerning the inertia of the very reed are stored in the memory 15; in particular, such data consist in the $P_{on}$ value of the P pressure relating to the air pumped by the bellow 6 at which the reed starts to vibrate, the $P_{off}$ value of the P pressure relating to the air pumped by the bellow 6 at which the reed stops vibrating (the $P_{on}$ value is usually higher than the $P_{off}$ value) and the parameters of an up/down sound ramp S ranging from 0 up to the nominal value and backwards.

Of course each reed is characterized by its own data relating to its inertia that are usually different from one reed to another.

Each ramp S is just a function normalized between 0 and 1 and it's used as a multiplier of the volume generated by a sound generator 17 so as to obtain a progressive increase/decrease of the sound generated by the very sound generator 17. Each ramp S is preferably an exponential function of the first order that is determined by the value of its time constant; moreover, each ramp S can be either symmetric, that is it can use the same time constant for both increase and decrease, or asymmetric, that is the time constant used for the increase is different from the time constant used for the decrease.

Figure 3:
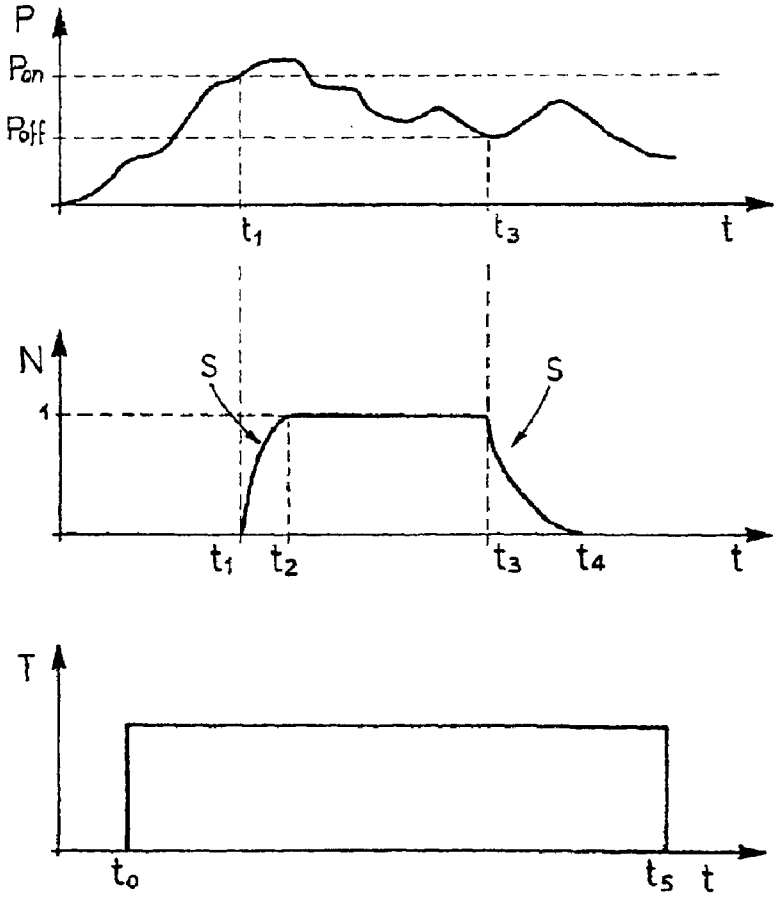
FIG. 3 shows the temporal evolution of some physical magnitudes relating to the electronic accordion shown in FIG. 1.

As shown in FIG. 3, in the moment $t_0$ the user presses a key/button 3 in the keyboards 2, so a consequent corresponding variation in the related T signal is generated; such variation in the related T signal is detected by the processor 16, which acquires from the memory 15 the corresponding sound with opened valve, the corresponding $P_{on}$ and $P_{off}$ values and all the features of the corresponding ramp S, all of them being characteristic of each reed that would be coupled with a pressed key/button 3 in an acoustic accordion (while non operating valves would be left out depending on the values given to the VC control variables).

For each reed coupled with the pressed key/button 3 and for the whole time period in which the key/button 3 is kept pressed the processor 16 operates a corresponding sound generator 17 in order to generate the characteristic sound with opened valve in that very reed; the generation volume of the sound generator 17 is modulated by a signal being normalized between 0 and 1 (indicated by the N character in the FIG. 3), which is kept at the 0 value as long as the real pressure P is lower than the corresponding $P_{on}$ value, then it's gradually increased to the 1 value by means of the related increase ramp S if the real pressure P becomes higher than the corresponding $P_{on}$ value (instant $t_1$), it's kept at the 1 value as long as the real pressure P exceeds the corresponding $P_{off}$ value, and it's gradually decreased to the 0 value by means of the related decrease ramp S if the real pressure P becomes lower than the corresponding $P_{off}$ value (instant $t_3$).

According to a preferred embodiment, the increase ramp S related to each reed is continuously modified depending on the real pressure P value related to the air pumped by the bellow 6 (i.e. depending on the ratio between the P value and the corresponding $P_{on}$ and/or $P_{off}$ value) and depending on the time elapsed from the last release of the key/button 3 associated with that very reed; in particular, the duration of the increase ramp S is reduced in a manner that is directly depending on the value P and inversely depending on the time elapsed from the latest release of the key/button 3. By acting as described above, the fact is simulated that a reed in an acoustic accordion starts vibrating within a shorter time if the pressure of the air pumped by the bellow is high and if that reed is still moving. Alternatively, instead of the time elapsed from the latest release of the key/button 3, the pressure density of a key/button 3 can be used, that is the number of times when a key/button 3 has been pressed in a certain temporal window.

In a classical accordion, when a key/button is released and the corresponding valve is closed, each reed associated with that valve does not stop vibrating instantaneously because of its own mechanical inertia; moreover, when the valve is stopped, the vibrating reed does not give off any harmonic sound as when its valve is open any longer but it starts emitting a metallic and partially distorted sound, whose amplitude (volume) gradually decreases and fades out. The bigger a reed is the louder its metallic sound is; the amplitude and the duration of such metallic sound depend on both the value of the air pressure in the moment when the valve is closed as well as the time interval in which the reed was vibrating because the valve was open.

When a key/button 3 in the keyboards 2 is released, a corresponding variation in the T signal is generated; this variation in the related T signal is detected by the processor 16, which switches off the sound generators 17 that are reproducing the characteristic sounds of the reeds that would be coupled with the key/button in 3 in an acoustic accordion. To switch each sound generator 17 off, that is currently generating the characteristic sound with open valve of a related reed, the processor 16 acquires the characteristic sound produced by the same corresponding reed with a stopped valve from the memory 15 and it drives the sound generator 17 so as to make it generate such characteristic sound with stopped valve and with an amplitude and duration that depend on the instantaneous value of the air pressure P in the bellow 6 on releasing the key/button 3 as well as on the time interval for which the key/button 3 has been kept pressed; in particular the characteristic sound with closed valve is generated with a volume which is gradually extinguished by the modulation of an exponential ramp.

In an acoustic accordion, when a key is released, the related valve is consequently closed thus generating an harmonic closing noise, which is clearly perceived by the ear of an expert listener even though it's rather low.

When a key/button 3 in the keyboards 2 is released, a consequent variation in the related T signal is generated; such variation in the related T signal is detected by the processor 16, which acquires both the number of the released key/button 3 as well as the release dynamics (that is the release velocity).

In order to reproduce the closing valve noise, when a key/button 3 is released, the processor 16 acquires from the memory 15 the characteristic closing sound of the related valve and it operates a sound generator 17 so as to reproduce such closing sound with an amplitude (i.e. volume) and a duration which depend on the release dynamics; in particular, the amplitude and the duration of the closing sound increase as the release velocity increase. According to a preferred embodiment, each closing sound is reproduced with an amplitude, namely a volume, that is consistently decreasing in a time period starting from a maximum value down to the zero value (at which a the corresponding sound generator 17 is switched off) by means of an exponential ramp.

To better simulate the behavior of an acoustic accordion, at regular time intervals the processor 16 acquires the pressure value P relating to the air pumped by the bellow 6 and compares such value with the pre-determined threshold value $P_s$, that is stored in the memory 15; when the value P exceeds the value $P_s$ the sound produced by each operating sound generator 17 reproducing the vibration of a corresponding reed is altered by decreasing the pitch of the very sound by a corresponding quantity I, that is stored in the memory 15, is peculiar to each reed and is either constant or variable in a manner being directly dependent on the value of the pressure P. Each quantity I is characteristic of a corresponding reed and usually the lower the sound produced by a reed is, the higher the quantity is (the quantity may even be zero for the highest notes). Obviously when the P value becomes smaller than the $P_s$ value, the pitch decrease is eliminated and the sound produced by each operating sound generator 17 reproducing the vibration of the corresponding reed is given its original pitch back. When increasing the volume, that is when increasing the pressure P of the air pumped by the bellow, the pitch decrease by the quantity I per single operating reed brings about a richer sound due to possible beat or untuning effects.

An acoustic accordion can be tuned up so as to acquire the so-called "musette" tone, which requires some slight tuning differences among reeds of the same footage so as to originate beat occurrences in its sound that provoke a "tremolo" effect of the sound. When the user acts on a corresponding register 5 in the electronic accordion 1 to select the "musette" tone, the processor 16 changes the value of a related control variable VC in the memory 15 in order to start the "musette" function; this function slightly alters the pitch of some sounds that are characteristic of certain reeds in order to simulate the tuning differences when such characteristic sounds are retrieved from the memory 15 to be reproduced by the corresponding sound generators 17. The characteristic sound of every reed is modified by a corresponding quantity, which is usually peculiar to each reed, and whose value can be adjusted by the user by means of an adjusting parameter.

As described above, it is clear that the sound of the electronic accordion 1 produced by the sound module 12 features both the timbre variance, namely the sound is shaped by the pressure of the air pumped by the bellow 7, as well as the articulation, namely the sound is modified to take all the peculiarities of an acoustic accordion into account.

Thanks to these features, the sound of an electronic accordion 1 being produced by a sound module 12 is characterized by a high quality level and can even be used for professional performances.

What is claimed is:

1. A method for electronically reproducing the sound of an acoustic accordion provided with a number of reeds coupled with valves, the method comprising the steps of:

storing in a memory of an electronic accordion sampled characteristic sounds produced by the vibration of respective reeds of the acoustic accordion;

associating each stored characteristic reed sound with relevant keys of said electronic accordion such that at least one of the keys is associated with more than one of the stored characteristic sounds of single reeds;

detecting air pressure provided by a bellows;

continually detecting pressure on a key; and electronically reproducing the characteristic sound of the acoustic accordion upon pressing said key by generating electronically the sampled characteristic sound of single reeds associated with the pressed key including modifying the generation of the sampled characteristic sound of at least one of the single reeds associated with the pressed key based on the bellows air pressure independent of generating the sampled characteristic sound of at least one of the other reeds associated with the pressed key.

2. A method according to claim 1, wherein said characteristic sounds are grouped into a series of footages, and wherein in said electronic accordion footages are activated or deactivated by corresponding selectors upon pressing each said key, the characteristic sounds belonging to an active footage are electronically generated individually for respective characteristic sounds of single reeds.

3. A method according to claim 1, wherein the value of a pressure variable (P) is continually detected comparable to the pressure of the air pumped by a bellow in an acoustic accordion; the characteristic sound of each reed being generated individually with an amplitude that depends directly on the value of said pressure variable (P).

4. A method according to claim 1, wherein the value of a pressure variable (P) is continually detected comparable to the pressure of the air pumped by a bellow in an acoustic accordion; the electronic generation of the characteristic sound of each reed is started only when said pressure variable (P) results to exceed a first predetermined threshold value (Pon).

5. A method according to claim 4, wherein in an initial stage of the electronic generation of a characteristic sound of a single reed, the generation amplitude of the characteristic sound is modulated by means of an exponential increase ramp starting from the zero value up to a regular value to reach gradually.

6. A method according to claim 4, wherein the electronic generation of the characteristic sound of each reed is interrupted if said pressure variable (P) is lower than a second predetermined threshold value (Poff).

7. A method according to claim 6, wherein the electronic generation of the characteristic sound of each reed is interrupted by means of an exponential decrease ramp (S), which brings the generation amplitude relating to the very characteristic sound gradually to the zero value.

8. A method according to claim 6, wherein said first threshold value (Pon) exceeds said second threshold value (Poff).

9. A method according to claim 4, wherein each said threshold value is peculiar to each said characteristic reed sound.

10. A method according to claim 5, wherein the value of a time constant of each said ramp (S) depends on the value of said pressure variable (P) and on the time interval elapsed from the latest release of the associated key.

11. A method according to claim 5, wherein said increase ramp (S) and said decrease ramp (S) feature different time constants.

12. A method according to claim 1, wherein in an initial stage of the electronic generation of the characteristic sound of each reed the amplitude of the characteristic sound is modulated by means of an exponential ramp (S) starting from the zero value and rising gradually up to a regular value.

13. A method according to claim 1, wherein on releasing said key, said electronic generation of the characteristic sound is interrupted by means of an exponential decrease ramp, which gradually decreases the generation amplitude of the very characteristic sound down to zero.

14. A method according to claim 13, wherein both the characteristic sound of the vibration of the reed with its corresponding opened valve as well as the characteristic sound of the vibration of the reed with its corresponding closed valve are stored as respective characteristic sounds of each reed; upon pressing said key-the characteristic sound of each reed with opened valve is electronically generated; upon releasing the key the electronic generation of the characteristic sound of each reed with opened valve is replaced by the electronic generation of the characteristic sound with closed valve.

15. A method according to claim 14, wherein said electronic generation of the characteristic sound with closed valve occurs with a progressively decreasing amplitude so as to reach the zero value by means of an exponential ramp.

16. A method according to claim 1, wherein the value of a pressure value (P) is detected comparable to the pressure of the air pumped by a bellow in an acoustic accordion; when the value of said pressure variable (P) exceeds a pre-determined threshold value (Ps), the electronic generation of each said characteristic reed sound is modified by decreasing the pitch of a determined first quantity (I).

17. A method according to claim 16, wherein said determined first quantity (I) is peculiar to each said characteristic reed sound.

18. A method according to claim 16, wherein said determined first quantity (I) is variable and depends directly on the value of said pressure variable (P).

19. A method according to claim 1, wherein in order to reproduce a tone called "musette" the pitch of at least some characteristic reed sounds is modified by a second determined quantity.

20. A method according to claim 19, wherein said second determined quantity is peculiar to each said characteristic reed sound.

21. A method according to claim 19, wherein the value of said determined quantity can be set by the user by means of an adjusting parameter.

22. A method according claim 1, wherein in an acoustic accordion the characteristic sound of the closing of said related valve is stored; upon releasing the key the characteristic sound for the closing of said related valve is electronically generated.

23. A method according to claim 22, wherein said electronic generation of the characteristic sound of closing said related valve occurs with an amplitude that decreases progressively during time by means of an exponential ramp so as to reach the zero value.

24. A method according to claim 22, wherein the duration and amplitude of said electronic generation of the characteristic sound of closing the valve depends on the release dynamics of the key.

25. A method for electronically reproducing the sound of an acoustic accordion provided with a number of reeds coupled with-valves; the method comprising the steps of:

storing in a memory of an electronic accordion sampled characteristic sounds produced by vibration of respective single reeds of the acoustic accordion; wherein both the characteristic sound of the vibration of the reed with its corresponding opened valve as well as the characteristic sound of the vibration of the reed with its corresponding closed valve are stored as respective characteristic sounds of each reed;

associating each stored characteristic reed sound with relevant keys of said electronic accordion such that at least one of the keys is associated with more than one of the stored characteristic sounds of single reeds;

continually detecting the pressure on a key;

electronically reproducing the characteristic sound of the acoustic accordion upon pressing said key by generating electronically the sampled characteristic sounds of the vibration of single reeds associated with the pressed key such that each sampled characteristic sound of the vibration of a single reed is generated independently of other sampled characteristic sounds of the vibration of single reeds;

upon pressing said key the characteristic sound of the vibration of each reed with open valve is electronically generated; and upon releasing the key the electronic generation of characteristic sound of the vibration of each reed with open valve is replaced by the electronic generation of the characteristic sound of the vibration of each reed with closed valve.

26. A method according to claim 25, wherein said electronic generation of the characteristic sound with closed valve occurs with a progressively decreasing amplitude so as to reach the zero value by means of an exponential ramp.

27. A method for electronically reproducing the sound of an acoustic accordion provided with a number of reeds, the method comprising the steps of:

storing in a memory of an electronic accordion characteristic sounds corresponding to the sound of vibration of respective single reeds of the acoustic accordion;

associating each stored characteristic reed sound with relevant keys of said electronic accordion such that at least one of the keys is associated with more than one of the stored characteristic sounds of single reeds;

detecting air pressure provided by a bellows;

detecting the pressure on a key;

electronically reproducing the characteristic sound of the acoustic accordion upon pressing said key by generating electronically the characteristic sound corresponding to the sound of vibration of single reeds associated with the pressed key including modifying the generation of the characteristic sound corresponding to the sound of the vibration of at least one of the single reeds associated with the pressed key based on air pressure from the bellows independent of generating the characteristic sound corresponding to the sound of vibration of at least one of the other reeds associated with the pressed key.

28. A method according to claim 27, wherein upon releasing the key, said electronic generation of the characteristic sound includes electronic generation of a characteristic sound of closing a related valve occurs with an amplitude that decreases progressively during time by means of an exponential ramp so as to reach the zero value.

29. A method according to claim 27, wherein upon releasing the key, said electronic generation of the characteristic sound includes electronic generation of a characteristic sound of closing a related valve and wherein the duration and amplitude of said electronic generation of the characteristic sound of closing the valve depends on the release dynamics of the key.

30. A method according to claim 1, wherein modifying the generation of the sampled characteristic sound comprises selectively turning on or off the generation of the characteristic sound of at least one single reed associated with the pressed key based on air pressure from the bellows and independent of the generation of the characteristic sound of at least one other reed associated with the pressed key.

31. A method according to claim 1, wherein modifying the generation of the sampled characteristic sound comprises shifting the pitch of the characteristic sound of at least one single reed associated with the pressed key upon air pressure from the bellows crossing a predefined threshold value.

32. A method according to claim 1, wherein modifying the generation of the sampled characteristic sound comprises decreasing the pitch of the characteristic sound of at least one single reed associated with the pressed key upon air pressure from the bellows exceeding a predefined threshold value.

33. A method according to claim 32, wherein the predefined threshold value is variable, depending upon the pressure of air from the bellows.

34. A method according to claim 1, wherein modifying the generation of the sampled characteristic sound comprises:

associating a first pressure value with each stored sampled characteristic reed sound such that each stored sampled characteristic reed sound has associated therewith a first pressure value that is different from the first pressure value associated with at least one other stored sampled characteristic reed sound, and generating the characteristic sound corresponding to the sound of vibration of at least one of the single reeds associated with the pressed key upon the air pressure from the bellows rising from below and exceeding the first pressure value associated with the stored characteristic sound of the at least one single reed.

35. A method according to claim 34, wherein modifying the generation of the sampled characteristic sound further comprises:

associating a second pressure value with each stored characteristic reed sound, and stopping a generation of the characteristic sound corresponding to the sound of vibration of at least one of the single reeds associated with the pressed key upon the air pressure from the bellows falling from a value above to a value below the second pressure value associated with the stored characteristic sound of the at least one single reed.

36. A method according to claim 27, wherein modifying the generation of the characteristic sound comprises selectively turning on or off the generation of the characteristic sound of at least one single reed associated with the pressed key based on air pressure from the bellows and independent of the generation of the characteristic sound of at least one other reed associated with the pressed key.

37. A method according to claim 27, wherein modifying the generation of the characteristic sound comprises shifting the pitch of the characteristic sound of at least one single reed associated with the pressed key upon air pressure from the bellows crossing a predefined threshold value.

38. A method according to claim 27, wherein modifying the generation of the characteristic sound comprises decreasing the pitch of the characteristic sound of at least one single reed associated with the pressed key upon air pressure from the bellows exceeding a predefined threshold value.

39. A method according to claim 38, wherein the predefined threshold value is variable, depending upon the pressure of air from the bellows.

40. A method according to claim 27, wherein modifying the generation of the characteristic sound comprises:

associating a first pressure value with each stored characteristic reed sound such that each stored characteristic reed sound has associated therewith a first pressure value that is different from the first pressure value associated with at least one other stored characteristic reed sound, and generating the characteristic sound corresponding to the sound of vibration of at least one of the single reeds associated with the pressed key upon the air pressure from the bellows rising from below and exceeding the first pressure value associated with the stored characteristic sound of the at least one single reed.

41. A method according to claim 40, wherein modifying the generation of the characteristic sound further comprises:

associating a second pressure value with each stored characteristic reed sound, and stopping a generation of the characteristic sound corresponding to the sound of vibration of at least one of the single reeds associated with the pressed key upon the air pressure from the bellows falling from a value above to a value below the second pressure value associated with the stored characteristic sound of the at least one single reed.

42. An electronic accordion apparatus for electronically reproducing the sound of an acoustic accordion provided with a number of reeds, the apparatus comprising:

a memory for electronically storing characteristic sounds corresponding to the sound of vibration of respective single reeds of the acoustic accordion;

a plurality of keys, each key being associated with at least one stored characteristic sound of a single reed such that at least one of the keys is associated with more than one of the stored characteristic sounds of single reeds;

a bellows for providing a variable air pressure;

an air pressure detector for detecting the air pressure provided by the bellows;

a key detector for detecting the pressure on a key;

a sound generator and processor configured for electronically reproducing the characteristic sound of the acoustic accordion upon pressing said key by generating electronically the characteristic sound corresponding to the sound of vibration of single reeds associated with the pressed key including modifying the generation of the characteristic sound corresponding to the sound of the vibration of at least one of the single reeds associated with the pressed key based on detected air pressure from the bellows independent of generating the characteristic sound corresponding to the sound of vibration of at least one of the other reeds associated with the pressed key.

43. An apparatus according to claim 42, wherein modifying the generation of the sampled characteristic sound comprises selectively turning on or off the generation of the characteristic sound of at least one single reed associated with the pressed key based on air pressure from the bellows and independent of the generation of the characteristic sound of at least one other reed associated with the pressed key.

44. An apparatus according to claim 42, wherein modifying the generation of the sampled characteristic sound comprises shifting the pitch of the characteristic sound of at least one single reed associated with the pressed key upon air pressure from the bellows crossing a predefined threshold value.

45. An apparatus according to claim 42, wherein modifying the generation of the sampled characteristic sound comprises:

associating a first pressure value with each stored characteristic reed sound such that each stored characteristic reed sound has associated therewith a first pressure value that is different from the first pressure value associated with at least one other stored characteristic reed sound, and generating the characteristic sound corresponding to the sound of vibration of at least one of the single reeds associated with the pressed key upon the air pressure from the bellows rising from below and exceeding the first pressure value associated with the stored characteristic sound of the at least one single reed.

46. An apparatus according to claim 42, wherein modifying the generation of the sampled characteristic sound further comprises:

associating a second pressure value with each stored characteristic reed sound, and stopping a generation of the characteristic sound corresponding to the sound of vibration of at least one of the single reeds associated with the pressed key upon the air pressure from the bellows falling from a value above to a value below the second pressure value associated with the stored characteristic sound of the at least one single reed.

* * * * *